US008296959B1

(12) United States Patent
Brooks

(10) Patent No.: US 8,296,959 B1
(45) Date of Patent: Oct. 30, 2012

(54) SELF-RETAINING PIPE CUTTING TEMPLATE

(76) Inventor: John A. Brooks, Fletcher, NC (US)

( * ) Notice: Subject to any disclaimer, the term of this patent is extended or adjusted under 35 U.S.C. 154(b) by 494 days.

(21) Appl. No.: 12/511,219

(22) Filed: Jul. 29, 2009

(51) Int. Cl.
*B43L 9/00* (2006.01)

(52) U.S. Cl. ..... 33/21.3; 33/21.1; 33/562

(58) Field of Classification Search ..... 33/21.1, 33/21.3, 27.12, 41.6, 562
See application file for complete search history.

(56) References Cited

U.S. PATENT DOCUMENTS

| | | | | | |
|---|---|---|---|---|---|
| 1,683,953 | A * | 9/1928 | Carr | 33/529 |
| 2,155,705 | A * | 4/1939 | Gottwald | 269/2 |
| 2,449,265 | A * | 9/1948 | Williams | 138/118 |
| 2,460,412 | A * | 2/1949 | Douglass | 33/21.3 |
| 2,985,963 | A * | 5/1961 | Lee | 33/21.3 |
| 3,128,560 | A * | 4/1964 | Mckenzie | 33/529 |
| 3,209,459 | A * | 10/1965 | Fish, Jr. | 33/562 |
| 3,407,507 | A * | 10/1968 | Brubaker | 33/555.4 |
| 4,215,481 | A * | 8/1980 | Riley | 33/529 |
| 4,219,370 | A * | 8/1980 | Hoaglin et al. | 148/196 |
| 4,381,854 | A * | 5/1983 | Bruner | 266/54 |
| 4,483,721 | A * | 11/1984 | Hearn | 148/201 |
| 4,565,012 | A * | 1/1986 | Bilodeau et al. | 33/458 |
| 4,618,378 | A * | 10/1986 | Huckaby | 148/201 |
| 4,653,195 | A * | 3/1987 | Esparza | 33/529 |
| D319,794 | S | 9/1991 | Elkins | |
| 5,450,677 | A * | 9/1995 | Casey | 33/529 |
| 6,209,215 | B1 * | 4/2001 | Helms | 33/529 |
| 6,470,586 | B2 * | 10/2002 | Kneipp | 33/529 |
| 7,003,893 | B1 | 2/2006 | Phuly | |
| 7,111,409 | B2 * | 9/2006 | Janssen | 33/555.4 |
| 7,251,902 | B1 | 8/2007 | Mueller | |
| 7,350,311 | B2 | 4/2008 | Marks | |
| 7,926,196 | B2 * | 4/2011 | Mueller et al. | 33/529 |
| 2006/0123650 | A1 * | 6/2006 | Mullins | 33/566 |
| 2006/0225291 | A1 | 10/2006 | Marks | |
| 2011/0132159 | A1 * | 6/2011 | Goodman, Jr. | 83/13 |

OTHER PUBLICATIONS

Pipeproguides.com internet web pages: pipeproguides.com/logo.html; pipeproguides.com/navbar.html; pipeproguides.com/plastic_and_metal_pipe_cutting_guides.shtml; pipeproguides.com/pipe_cutting_guides.html Effective date unknown.

* cited by examiner

*Primary Examiner* — G. Bradley Bennett
*Assistant Examiner* — Tania Courson
(74) *Attorney, Agent, or Firm* — Carter & Schnedler, P.A.

(57) ABSTRACT

Pipe cutting templates for marking cutting lines on pipes for subsequent connection to another pipe. A template includes a flexible magnetic sheet having a front surface and a rear magnetized surface for retaining the sheet on the pipe. The sheet has a pair of straight side edges parallel to each other and defining a width of the sheet, the width of the sheet corresponding to the diameter of the pipe such that, during use when the sheet is wrapped around the pipe, the side edges abut. The sheet additionally has a pair of opposed end edges. At least one of the end edges is contoured to serve as a guide for marking the pipe with a cutting line corresponding to the pipe diameter, at least one particular connection type, and at least one particular angle of connection.

5 Claims, 4 Drawing Sheets

SELF-RETAINING PIPE CUTTING TEMPLATE

BACKGROUND OF THE INVENTION

The invention relates to pipe cutting templates for marking cutting lines on pipes for subsequent connection to another pipe.

The development and use of pipe cutting templates is well known for the fabrication of various connection or intersection types, such as end-to-end pipe connections at various angles such as 45°, 90°, and 180° (straight end-to-end); as well as connections or intersections between a trunk pipe and a branch pipe, which require a saddle or cope contoured cut.

SUMMARY OF THE INVENTION

In one aspect, a wrap-around pipe cutting template for marking a cutting line on a pipe having a particular diameter and a corresponding circumference for cutting the pipe in preparation for connection to another pipe employing at least one particular connection type and at least one particular angle of connection is provided. The template includes a flexible magnetic sheet having a front surface and a rear magnetized surface for retaining the sheet on the pipe; the sheet having a pair of straight side edges parallel to each other and defining a width of the sheet, the width of the sheet corresponding to the diameter of the pipe such that, during use when the sheet is wrapped around the pipe, the side edges abut; and the sheet additionally having a pair of opposed end edges, at least one of the end edges contoured to serve as a guide for marking the pipe with a cutting line corresponding to the pipe diameter, the at least one particular connection type, and the at least one particular angle of connection.

In another aspect, a set of wrap-around pipe cutting templates for marking cutting lines on pipes having various particular diameters and corresponding circumferences for cutting a pipe in preparation for connection to another pipe employing various connection types and at various particular angles of connection is provided. The set includes a plurality of flexible magnetic sheets, each of the sheets having a front surface and a rear magnetized surface for retaining the sheet on the pipe. Each of the sheets has a pair of straight side edges parallel to each other and defining a width of the sheet, the width of the sheet corresponding to the diameter of the pipe such that, during use when the sheet is wrapped around the pipe, the side edges abut. Each of the sheets additionally has a pair of opposed end edges, at least one of the end edges contoured to serve as a guide for marking the pipe with a cutting line corresponding to the pipe diameter, the at least one particular connection type, and the at least one particular angle of connection.

In yet another aspect, a method of cutting a pipe having a particular diameter and a corresponding circumference in preparation for connection to another pipe employing at least one particular connection type and at least one particular angle of connection is provided. The method includes the step of providing a wrap-around pipe cutting template sized for the particular pipe diameter and corresponding circumference, the template in turn including a flexible magnetic sheet having a front surface and a rear magnetized surface for retaining the sheet on the pipe, the sheet having a pair of straight side edges parallel to each other and defining a width of the sheet, the width of the sheet corresponding to the diameter of the pipe such that, during use when the sheet is wrapped around the pipe, the side edges abut, and the sheet additionally having a pair of opposed end edges, at least one of the end edges contoured to serve as a guide for marking the pipe with a cutting line corresponding to the pipe diameter, the at least one particular connection type, and the at least one particular angle of connection. The method includes the further steps of wrapping the template around the pipe and magnetically securing the template to the pipe so that the side edges abut, and employing the at least one of the end edges as a guide to mark the pipe for subsequent cutting.

DETAILED DESCRIPTION

Figure 1:
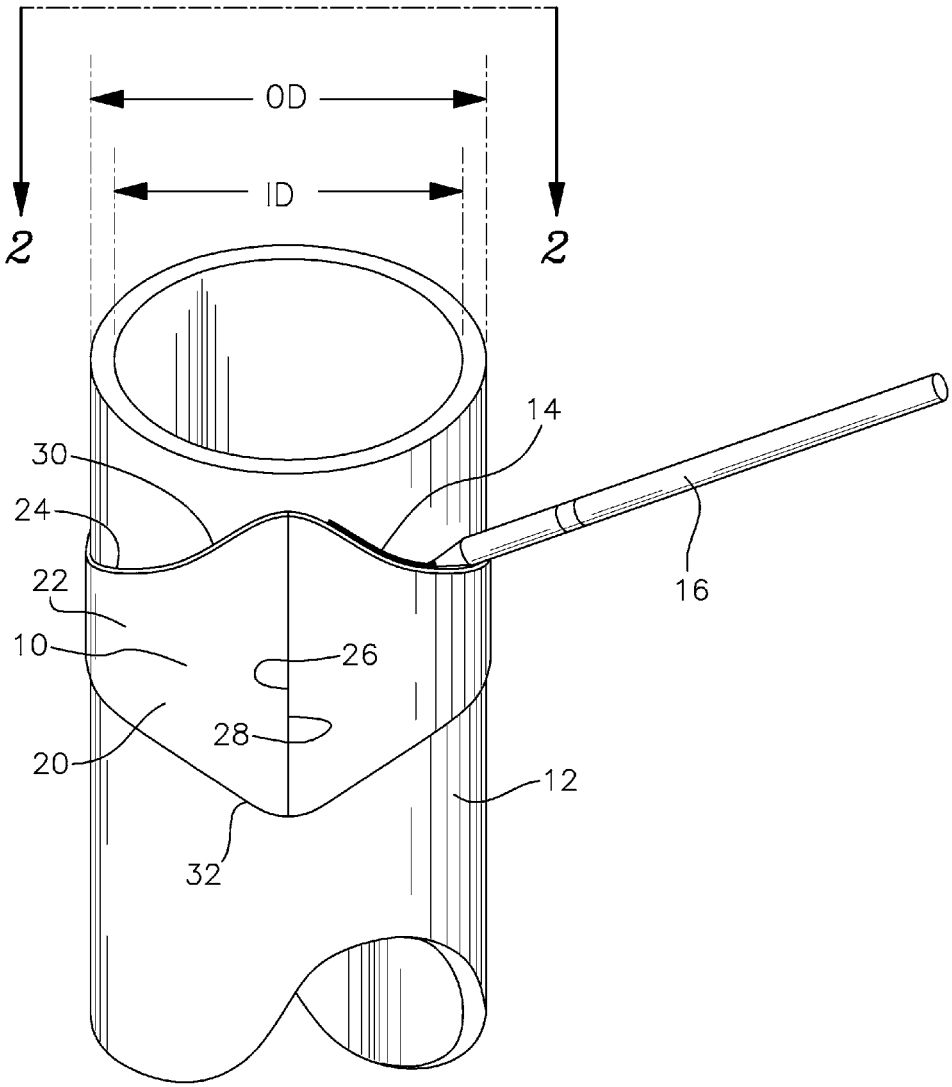
FIG. 1 is a three-dimensional illustration of a cutting template embodying the invention wrapped around a pipe and in use.
Figure 2:
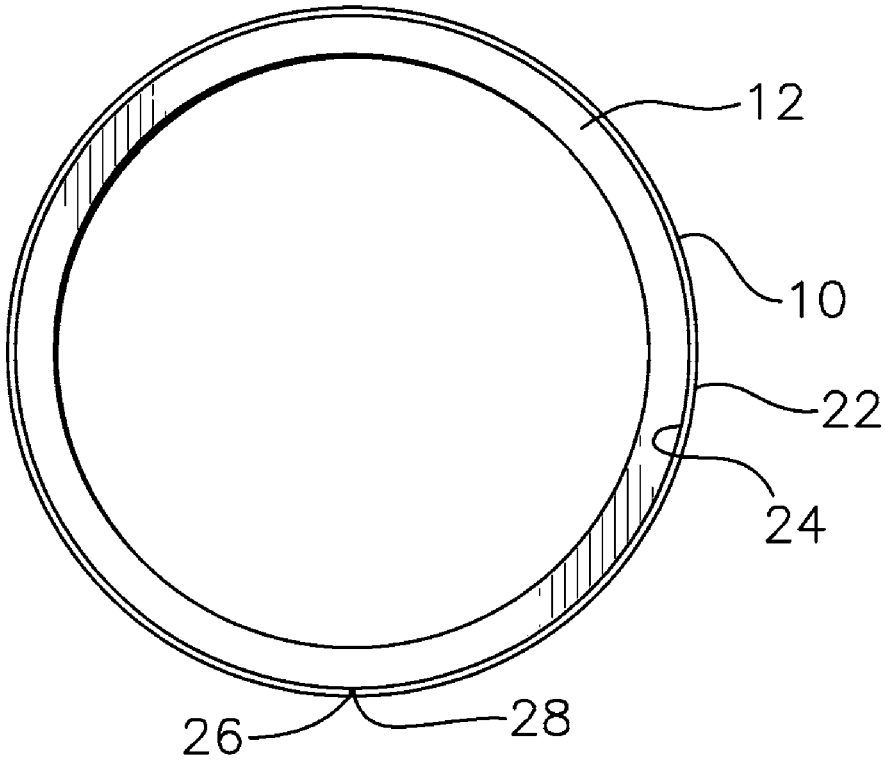
FIG. 2 is an end view taken generally on line 2-2 of FIG. 1.
Figure 3:
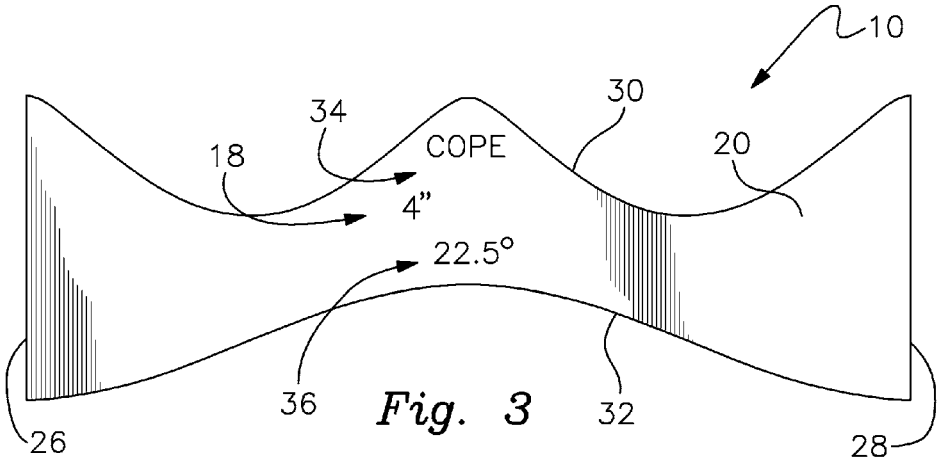
FIG. 3 is a developed view of a template embodying the invention sized for a pipe having an inside diameter (ID) of 4"

FIGS. 1 and 2 illustrate a representative wrap-around pipe cutting template 10 wrapped around a representative pipe 12 and in use as an aid for marking a cutting line, part of which is represented at 14, on the pipe 12. FIG. 3 shows the representative template 10 illustrated as it appears when laid out flat, i.e., a developed view. The cutting line 14 accordingly serves as a reference for subsequently cutting the pipe 12 in preparation for connection to another pipe (not shown). A representative marking device 16, such as a pen or pencil, is shown. As employed herein, the terminology "cutting line" does not necessarily refer to a continuous line. Rather, the cutting line 14 may take any form sufficient to guide a cutting device, such as a cutting torch. Examples are a series of dots (i.e. a dotted line) and a series of dashes (i.e. a dash line)

It will be appreciated that pipes are available in standard sizes, characterized by an inside diameter (ID) and an outside diameter (OD), as indicated in FIG. 1. Pipes are specified in various nominal sizes. For smaller diameter pipes, that is pipes up to twelve inches in diameter, the pipe size ordinarily is specified by the inside diameter (ID), and the outside diameter (OD) accordingly is greater in view of the pipe wall thickness. In any event, the representative template 10 is sized in view of the outside diameter (OD) of the pipe 12.

In FIG. 1, the representative pipe 12 has an inside diameter (ID) of four inches. The template 10, as illustrated in FIG. 3 when laid out flat, is marked with a pipe size indicium 18 which reads "4"," indicating the template 10 is for use with pipes having an ID of four inches.

The template 10 more particularly is made of flexible magnetic sheet, widely available as a stock material, and may be die cut. The flexible magnetic sheet 12 has a front surface 22 and a rear magnetized surface 24 for retaining the sheet 20 on the representative pipe 12. The flexible magnetic sheet 20 accordingly is self-retaining on the pipe 12 for convenient use, and additionally is sufficiently robust to serve repeatedly as a template, and has sufficient thickness to reliably guide the marking device 16. Accordingly, during use the template 10 is wrapped around the pipe 12, and magnetically secured.

With particular reference to FIG. 3, the flexible magnetic sheet 20 has a pair of straight side edges 26 and 28 which are parallel to each other and which define the width of the sheet 20. The width of the sheet 20 (between the two side edges 26 and 28) is equal to the nominal circumference of the pipe 12 corresponding to its nominal diameter. In this context, the term "diameter" refers to the outside diameter (OD). Accordingly, the width is such that, during use when the sheet 20 is wrapped around the pipe 12, the side edges 26 and 28 abut.

The sheet 20 additionally has a pair of opposed end edges 30 and 32. At least one of the end edges 30 and 32, and preferably both, is contoured to serve as a guide for marking the pipe 12 with a cutting line (e.g., the cutting line 14) corresponding to the pipe diameter, a particular desired connection or interface type, and a particular angle of connection.

In the example of FIG. 3, the upper end edge 30 is for marking a pipe to make a cope or saddle joint, employed to join the end of a branch pipe (the pipe 12 being marked) to a trunk pipe (not shown). The lower end edge 32 is employed to define a contour for cutting a pipe end at an angle of 22.5° (in the nature of a miter cut) for joining two pipes end-to-end at an angle of 45°. In addition to the pipe size indicium 18 ("4""), the template 10 is marked with exemplary connection type and angle indicia 34 and 36. Indicium 34 ("COPE") indicates the upper end edge 30 is for marking a cutting line for a cope or saddle joint, and indicium 36 ("22.5°") is for marking a cutting line for an angle cut of 22.5°.

Graphical techniques for generating template contours are well known. In addition, computer software packages are available for generating such contours. In addition, generalized 3D solid modeling software such as "Autodesk Inventor" can be employed.

Wrap-around pipe cutting templates embodying the invention preferably are provided as a set, represented by the templates of FIGS. 3-8 collectively, as a small but representative set. Thus, templates are provided for making cutting lines on pipes having various particular diameters (and corresponding circumferences) for cutting pipes in preparation for connection to another pipe employing various connection types and at various particular angles of connection.

In FIG. 1, the template is oriented in the same orientation as in FIG. 3 that is, with the end edge 30 employed as a marking guide. Alternatively, the template 10 of FIG. 3 can be placed in the opposite orientation, in which case the end edge 32 is employed as the marking guide.

Figure 4:
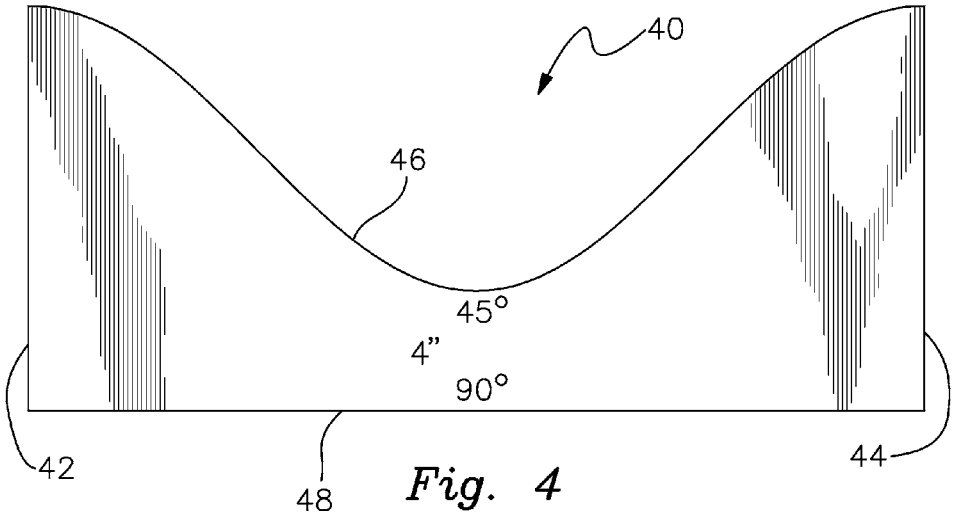
FIG. 4 is a developed view of another template embodying the invention, also sized for a 4" ID pipe.

FIG. 4 more particularly represents a template 40, also for a four inch ID pipe, having parallel side edges 42 and 44 and a pair of opposed end edges 46 and 48 contoured, respectively, for marking a pipe for cutting at a 45° angle for a 90° connection to another pipe, and for marking a pipe at a 90° angle for straight (e.g. 180°) end-to-end connection to another pipe.

Figure 5:
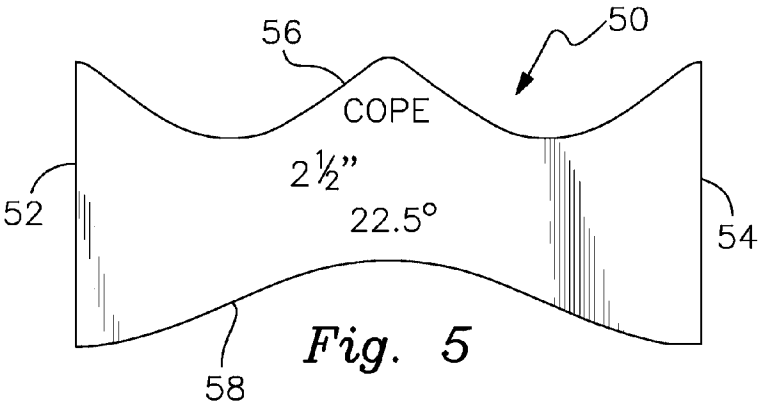
FIG. 5 is a developed view of another template embodying the invention, sized for a two and one-half inches ID pipe.

FIG. 5 represents a template 50 for marking cutting lines on a pipe having an ID of two and one-half inches. The template 50 has parallel side edges 52 and 54 and a pair of opposed end edges 56 and 58 contoured, respectively, for marking a pipe to make a cope or saddle joint, and for marking a pipe to make an angle cut of 22.5°.

Figure 6:
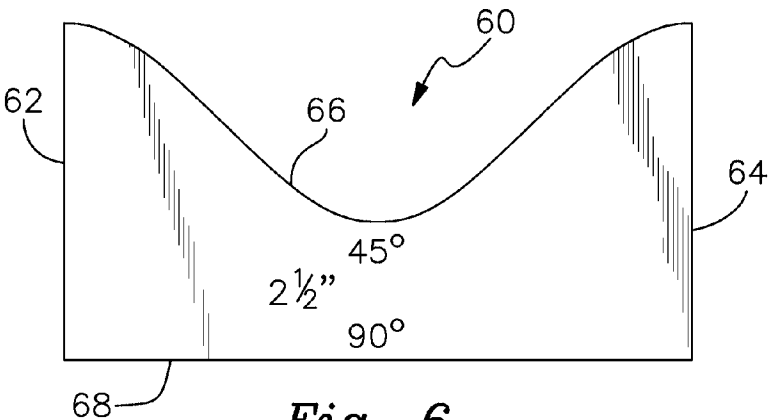
FIG. 6 is another template embodying the invention, also sized for a two and one-half inches ID pipe.

FIG. 6 represents another template 60 for a two and one-half inch ID pipe, having parallel side edges 62 and 64 and a pair of opposed end edges 66 and 68 contoured, respectively, for marking a pipe for cutting at a 45° angle for a 90° connection to another pipe, and for marking a pipe at a 90°angle for straight (e.g. 180°) end-to-end connection to another pipe.

Figure 7:
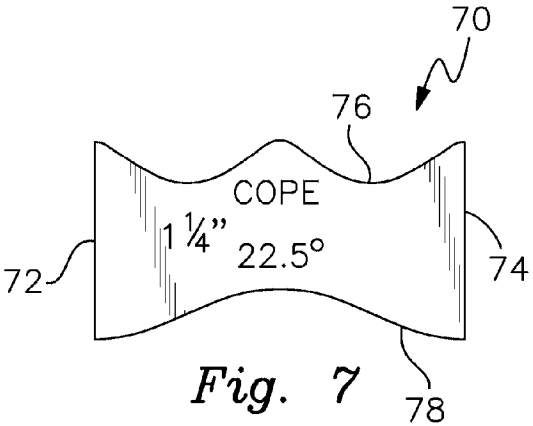
FIG. 7 is a developed view of another template embodying the invention, sized for a 1¼" ID pipe.

FIG. 7 represents a template 70 for marking cutting lines on a pipe having an ID of one and one-quarter inches. The template 70 has parallel side edges 72 and 74 and a pair of opposed end edges 76 and 78 contoured, respectively, for marking a pipe to make a cope or saddle joint, and for marking a pipe to make an angle cut of 22.5°.

Figure 8:
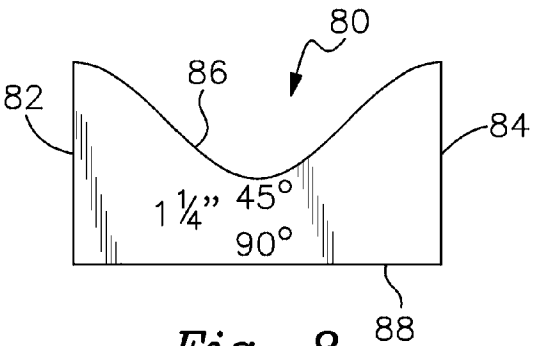
FIG. 8 is a developed view of another template embodying the invention, sized for a 1¼" ID pipe.

Finally, FIG. 8 represents another template 80 for a one and one-quarter inch ID pipe, having parallel side edges 82 and 84 and a pair of opposed end edges 86 and 88 contoured, respectively, for marking a pipe for cutting at a 45° angle for a 90° connection to another pipe, and for marking a pipe at a 90° angle for straight (e.g. 180°) end-to-end connection to another pipe.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

The invention claimed is:

1. A wrap-around pipe cutting template for marking a cutting line on a pipe having a particular diameter and a corresponding circumference for cutting the pipe in preparation for connection to another pipe employing at least one particular connection type and at least one particular angle of connection, said template comprising:

a flexible magnetic sheet having a front surface and a rear magnetized surface for retaining said sheet on the pipe;

said sheet having a pair of straight side edges parallel to each other and defining a width of said sheet, the width of said sheet corresponding to the diameter of the pipe such that, during use when said sheet is wrapped around the pipe, said side edges abut; and said sheet additionally having a pair of opposed end edges, at least one of said end edges not being straight but contoured to serve as a guide for marking the pipe with a curved cutting line corresponding to the pipe diameter, the at least one particular connection type, and the at least one particular angle of connection.

2. The template of claim 1, wherein another of said end edges is contoured to serve as a guide for marking the pipe with a cutting line corresponding to the pipe diameter, a particular connection type, and a particular angle of connection, either the particular connection type or the particular angle of connection of said other of said side edges differing from the particular connection type or the particular angle of connection of said at least one of said end edges.

3. A set of wrap-around pipe cutting templates for marking cutting lines on pipes having various particular diameters and corresponding circumferences for cutting a pipe in preparation for connection to another pipe employing various connection types and at various particular angles of connection, said set comprising:

a plurality of flexible magnetic sheets, each of said sheets having a front surface and a rear magnetized surface for retaining said sheet on the pipe;

each of said sheets having a pair of straight side edges parallel to each other and defining a width of said sheet, the width of said sheet corresponding to the diameter of the pipe such that, during use when said sheet is wrapped around the pipe, said side edges abut; and each of said sheets additionally having a pair of opposed end edges, at least one of said end edges not being straight but contoured to serve as a guide for marking the pipe with a curved cutting line corresponding to the pipe diameter, the at least one particular connection type, and the at least one particular angle of connection.

4. The template set of claim 3, wherein another of said end edges of each of said sheets is contoured to serve as a guide for marking the pipe with a cutting line corresponding to the pipe diameter, a particular connection type, and a particular angle of connection, either the particular connection type or the particular angle of connection of said other of said side edges differing from the particular connection type or the particular angle of connection of said at least one of said end edges.

5. A method of cutting a pipe having a particular diameter and a corresponding circumference in preparation for connection to another pipe employing at least one particular connection type and at least one particular angle of connection, said method comprising:

providing a wrap-around pipe cutting template sized for the particular pipe diameter and corresponding circumference, the template in turn comprising a flexible magnetic sheet having a front surface and a rear magnetized surface for retaining the sheet on the pipe, the sheet having a pair of straight side edges parallel to each other and defining a width of the sheet, the width of the sheet corresponding to the diameter of the pipe such that, during use when the sheet is wrapped around the pipe, the side edges abut, and the sheet additionally having a pair of opposed end edges, at least one of the end edges not being straight but contoured to serve as a guide for marking the pipe with a curved cutting line corresponding to the pipe diameter, the at least one particular connection type, and the at least one particular angle of connection;

wrapping the template around the pipe and magnetically securing the template to the pipe so that the side edges abut; and employing the at least one of the end edges as a guide to mark the pipe for subsequent cutting.

* * * * *